US009580964B2

(12) United States Patent
Schweiger et al.

(10) Patent No.: US 9,580,964 B2
(45) Date of Patent: Feb. 28, 2017

(54) DRILLING TOOL AND METHOD FOR EARTH DRILLING

(71) Applicant: BAUER SPEZIAL TIEFBAU GMBH, Schrobenhausen (DE)

(72) Inventors: Manfred Schweiger, Hilgertshausen (DE); Sandor Major, Vienna (AT); Andreas Stimpfle-Ziegler, Kuehbach (DE)

(73) Assignee: BAUER SPEZIALTIEFBAU GmbH, Schrobenhausen (DE)

( * ) Notice: Subject to any disclaimer, the term of this patent is extended or adjusted under 35 U.S.C. 154(b) by 296 days.

(21) Appl. No.: 14/189,678

(22) Filed: Feb. 25, 2014

(65) Prior Publication Data

US 2014/0238749 A1 Aug. 28, 2014

(30) Foreign Application Priority Data

Feb. 26, 2013 (EP) ..... 13156667

(51) Int. Cl.
*E21B 3/02* (2006.01)
*E21B 10/32* (2006.01)
*E21B 7/00* (2006.01)

(52) U.S. Cl.
CPC ..... *E21B 3/02* (2013.01); *E21B 7/005* (2013.01); *E21B 10/32* (2013.01)

(58) Field of Classification Search
CPC . E21B 3/02; E21B 10/32; E21B 10/44; E21B 7/005; E21B 7/046; E21B 7/201; E21B 17/22
See application file for complete search history.

(56) References Cited

U.S. PATENT DOCUMENTS 2,688,465 A 9/1954 Birdwell
2,912,228 A 11/1959 Kandle
3,077,235 A * 2/1963 Govin ..... E21B 7/005 175/258

(Continued)

FOREIGN PATENT DOCUMENTS

DE 32 19 362 C1 4/1983
EP 0171038 A2 2/1986

(Continued)

OTHER PUBLICATIONS

An European search report issued on Jul. 31, 2013, which corresponds to European Patent Application No. 13156667.1 and is related to U.S. Appl. No. 14/189,678.

*Primary Examiner* — Michael Wills, III
(74) *Attorney, Agent, or Firm* — Studebaker & Brackett PC

(57) ABSTRACT

The invention relates to a drilling tool for earth drilling with a drill rod element which can be connected to a rotary drive and can be driven in a rotating manner about a drilling axis, a frame-like housing and at least one removal tooth which is supported in a radially adjustable manner in the housing between a retracted position in the housing and an operating position, in which the at least one removal tooth projects radially from the housing.
Furthermore, on the drill rod element in the housing a transmission mechanism is arranged, through which a stroke and/or rotational movement of the drill rod element can be translated into a radial movement for radial adjustment of the at least one removal tooth.

9 Claims, 4 Drawing Sheets

(56) References Cited

U.S. PATENT DOCUMENTS

Figure 1:
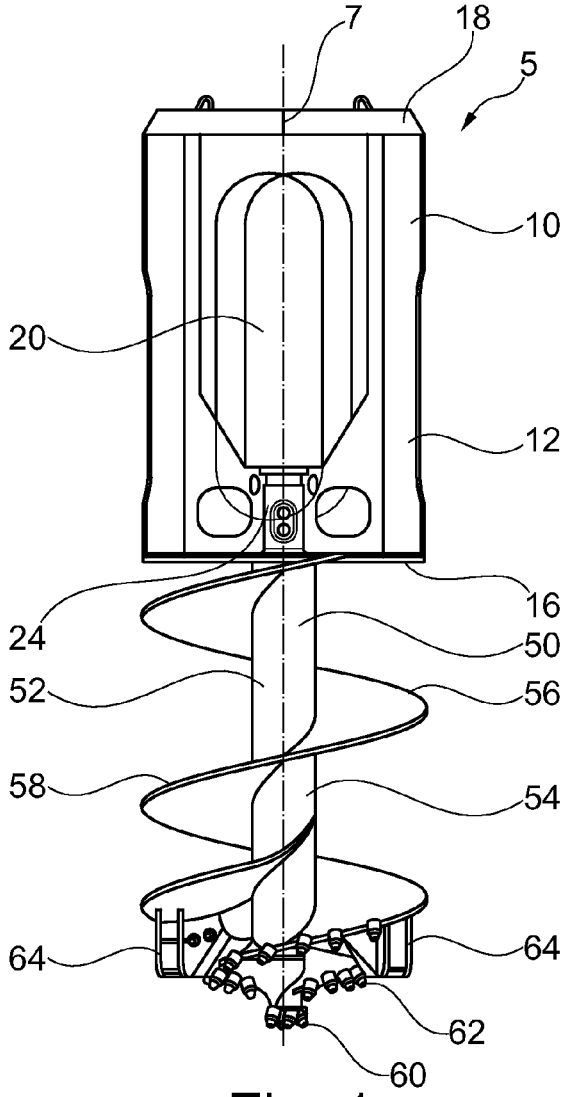

| | | | | | |
|---|---|---|---|---|---|
| 3,734,214 | A | * | 5/1973 | Benetti | E21B 10/44 175/171 |
| 3,864,923 | A | * | 2/1975 | Turzillo | E02D 5/38 175/171 |
| 4,116,012 | A | * | 9/1978 | Abe | E02D 5/50 175/171 |
| 4,202,416 | A | | 5/1980 | Blaschke et al. | |
| 4,548,282 | A | | 10/1985 | Hurtz et al. | |
| 4,604,818 | A | | 8/1986 | Inoue | |
| 5,219,246 | A | * | 6/1993 | Coutts | E02D 5/36 175/292 |
| 2007/0007043 | A1 | | 1/2007 | Dewey et al. | |

FOREIGN PATENT DOCUMENTS

| | | | |
|---|---|---|---|
| GB | 1455777 | A | 11/1976 |
| WO | 01/00961 | A1 | 1/2001 |

* cited by examiner

DRILLING TOOL AND METHOD FOR EARTH DRILLING

The invention relates to a drilling tool for earth drilling with a drill rod element which can be connected to a rotary drive and can be driven in a rotating manner about a drilling axis, a frame-like housing and at least one removal tooth which is supported in a radially adjustable manner in the housing between a retracted position in the housing and an operating position, in which the at least one removal tooth projects radially from the housing, in accordance with the preamble of claim 1.

The invention further relates to a method for producing a bore in the ground with a drilling tool of such type.

Drilling tools for earth drilling are employed, in particular, for the production of foundation piles for constructions. In this process, a drilling device with a rotary drill drive is used to introduce a drilling tool in a rotating manner into the ground, whereby ground material is removed and conveyed to the ground surface. As a result, a bore is produced that has a substantially uniform drilling diameter along the entire drilling depth.

In certain cases of application, however, it is desirable or necessary to enlarge the drilling diameter in a lower area of the bore. For this purpose, a generic drilling tool can be used for example, which is known from DE 32 19 362 C1. In the case of this known drilling tool, a removal tooth located on a housing-like basic body can be adjusted by means of a hydraulic cylinder from a retracted position into a radially projecting operating position. In this projecting removal position, on adjustment in the borehole, an enlarged drilling diameter can be achieved.

Once the enlargement of the drilling diameter has been implemented, the removal tooth can be retracted again by the hydraulic cylinder, allowing the drilling tool to be withdrawn through the upper borehole area with a smaller drilling diameter.

However, in the case of rotationally driven drilling tools with a drill rod the supply of hydraulic fluid to the drilling tool proves to be problematic. For a supply of hydraulic fluid from outside the borehole to a rotating drilling tool an essential requirement is a so-called rotary feed-through, in which a rotating connector part has to be sealed off against high pressures with respect to a stationary connector part. Moreover, the guidance and arrangement of the hydraulic lines in the borehole is susceptible to disturbances. In the case of fixed hydraulic lines along the drill rod additional sealings have to be provided if further drill rod elements need to be installed for adjustment to greater drilling depths. An alternative supply of hydraulic fluid via a flexible hose line is prone to damage under rough construction site conditions and moreover requires a separate hose supply with hose drum.

The invention is based on the object to provide a drilling tool and a method for earth drilling, with which an enlargement of the drilling diameter in a lower area of the borehole is rendered possible in a simple and reliable manner.

The object is achieved on the one hand by a drilling tool having the features of claim 1 and on the other hand by a method having the features of claim 10. Preferred embodiments of the invention are stated in the respective dependent claims.

The drilling tool according to the invention is characterized in that on the drill rod element in the housing a transmission mechanism is arranged, through which a stroke and/or rotational movement of the drill rod element can be translated into a radial movement for radial adjustment of the at least one removal tooth.

A basic idea of the invention resides in the fact that the energy required for actuating an adjustable removal tooth on the drilling tool is provided by a regular stroke and/or rotational movement of the drill rod. Hence, hydraulic or electric positioning members and the related supplies for hydraulic fluid or electricity can be dispensed with. For this purpose, a transmission mechanism is arranged in the housing of the drilling tool, through which a stroke or rotational movement of the drill rod element can be received and translated into a desired radial movement of the at least one removal tooth. Thus, a mechanical actuating gear is provided which is actuated directly by the drill rod and its movements. The drill rod serves in a known manner for the transmission of an axial feed movement during drilling and for the transmission of the drilling torque from a rotary drill drive arranged on the ground surface. By preference, a rotary drilling device with a vertical mast is provided, on which the drill drive is supported in a vertically movable manner on a drilling carriage in a known way.

The purely mechanical solution for the radial adjustment of removal teeth on the drilling tool is robust, requires little maintenance and is therefore less susceptible to disturbances.

A preferred embodiment of the drilling tool according to the invention resides in the fact that the transmission mechanism has a sliding sleeve which is supported in an axially slidable manner along the drilling axis, in that at least one sliding member is arranged which is supported in a radially adjustable manner in the housing and on which at least one removal tooth is mounted, and in that at least one deflection lever is articulated on the one hand to the sliding sleeve and on the other hand to the sliding member, wherein an axial stroke movement of the sliding sleeve can be translated by the deflection lever into a radial positioning movement of the sliding member. By preference, the sliding sleeve is supported in an axially slidable manner by being concentric to the drilling axis on the drill rod element or by forming part of the drill rod element of the drilling tool.

The axial sliding movement can preferably be brought about in that the drilling tool is placed onto the borehole bottom and due to the pressure applied from above the sliding sleeve is slid axially by a predetermined length. This sliding movement parallel to the drilling axis effects via radially directed, obliquely positioned deflection levers a radial positioning movement of a sliding member guided in a radially adjustable manner in the housing. Here, the sliding member serves as a support for receiving and holding one or several removal teeth.

Advantageously, the drilling tool according to the invention is developed further in that on an upper side an upper connector for a drill rod and on an underside a lower connector for a removal means for removing ground at the borehole bottom are provided. The drilling tool according to the invention can therefore be an intermediate or insertion element of a larger drilling tool unit. For instance as removal means a radially directed cutting bit or preferably an auger for discontinuous Kelly drilling can be provided. On the upper side an upper connector is preferably designed as a so-called Kelly box with a square opening. In this manner, a connection to a conventional drill rod, in particular a telescopic Kelly rod, can be established.

Another advantageous embodiment of the drilling tool according to the invention resides in the fact that by way of a fixing element the upper connector is connected to the lower connector in a torque-proof manner and by being axially slidable by a predetermined length of stroke and in that the axial length of stroke is limited by means of the sliding sleeve. Hence, the drill rod element extending through the housing is not rigid but is at least of a two-part design. Between both parts a coupling member can be provided which enables a torque-proof connection whilst allowing for an axial movement in relation to the drilling axis. To this end, a spline connection can be provided for example which is present as a coupling member on the inner surface or an outer surface of the fixing element. The axial positioning or stroke length is limited by mechanical stops.

An alternative embodiment of the drilling tool according to the invention can be seen in the fact that the transmission mechanism has a rotary member which is supported in a twistable manner about the drilling axis, in that at least one pivot member is arranged which is supported in a radially pivotable manner on the housing and on which at least one removal tooth is mounted, and in that at least one pivot lever is articulated on the one hand to the rotary member and on the other hand to the pivot member, wherein a twisting movement of the rotary member can be translated by the pivot lever into a radial positioning movement of the pivot member. As a result of this arrangement with a rotary member a twisting movement of the drill rod can be translated into a desired radial adjusting movement of the removal tooth. Similar to the previously described sliding sleeve the twisting movement of the rotary member can be limited by appropriate stops to a predetermined angle of rotation. The upper connector is also supported in a twistable manner with respect to the lower connector by an angular amount.

According to the invention an advantageous further development of this arrangement resides in the fact that the rotary member can be twisted between a first rotational position, in which the at least one removal tooth is located in the retracted position in the housing, and a second rotational position, in which the removal tooth is located radially outside the housing in the operating position, and in that the rotary member can be locked in the first rotational position and/or the second rotational position. A locking or unlocking can be effected by a bolting from outside the borehole. By preference, however, a locking or unlocking can be effected by an axial positioning movement of the drill rod, as it is known, for instance, from the locking or unlocking of a telescopic Kelly drill rod. For this purpose, appropriate axial locking pockets can be provided on the rod element of the drilling tool.

According to another development of the invention it is of advantage that on the underside a removal means for removing ground at the borehole bottom is connected. The removal means can be an auger in particular. However, other types of removal means, such as a drilling bucket, are conceivable, too.

Furthermore, in accordance with the invention it is preferred that the removal means is designed as an auger with at least one drill flight. However, two or more drill flights can also be arranged especially in the area of the lower cutting bit.

Especially in the case of longer augers it is of advantage in accordance with the invention that on the auger in a lower area at least one hinged tooth is arranged, which, when surrounding ground is present, can be swung out from a swung-in retracted position into a radially projecting removal position. By preference, two or more hinged teeth are pivotably supported at the lower end of the auger. The arrangement is preferably chosen such that in an unloaded state the hinged teeth are located in the swung-in retracted position and do not project radially with respect to the drill flights. When being placed onto the borehole bottom and exposed to the pressure of the drilling tool, the hinged teeth can then swing out into their removal position, in which they project radially with respect to the drill flights. In the removal position the hinged teeth on the auger preferably project just as much radially as the removal teeth of the drilling tool in the radially extended operating position.

The method according to the invention for producing a bore in the ground is characterized in that ground is removed at least temporarily with a drilling tool as described before. A drilling tool unit can be of modular design, with the drilling tool according to the invention being a modular component which is only installed on the drill rod for specific operational phases during the production of the borehole.

According to the invention a particularly preferred method variant resides in the fact that initially a cased bore is produced with a support pipe having an inner diameter and an outer diameter up to a first drilling depth, in that a subsequent bore is continued below the support pipe up to a second drilling depth, wherein the subsequent bore has a drilling diameter corresponding to the inner diameter of the support pipe, and in that at least in a partial area the drilling diameter of the subsequent bore is enlarged with the drilling tool according to the invention up to a drilling diameter which is equal to or larger than the outer diameter of the support pipe.

With this method a uniform bored or foundation pile with a constant drilling diameter can be produced, which, for the purpose of stabilizing the borehole, is provided in its upper area with a drill or support pipe. Generally, this support pipe consisting of metal only extends a few meters into the ground. The support or drill pipe is normally introduced additionally with the drilling tool into the ground. In customary drilling methods the problem is that below the support pipe the bore is limited to the inner diameter of the support pipe. With the drilling tool according to the invention there is now the possibility that through extension of the radially adjustable removal teeth a subsequent bore below the support pipe can easily be enlarged from a first drilling diameter corresponding to the inner diameter of the support pipe to a larger second drilling diameter, in particular to the outer diameter of the support pipe.

Figure 3:
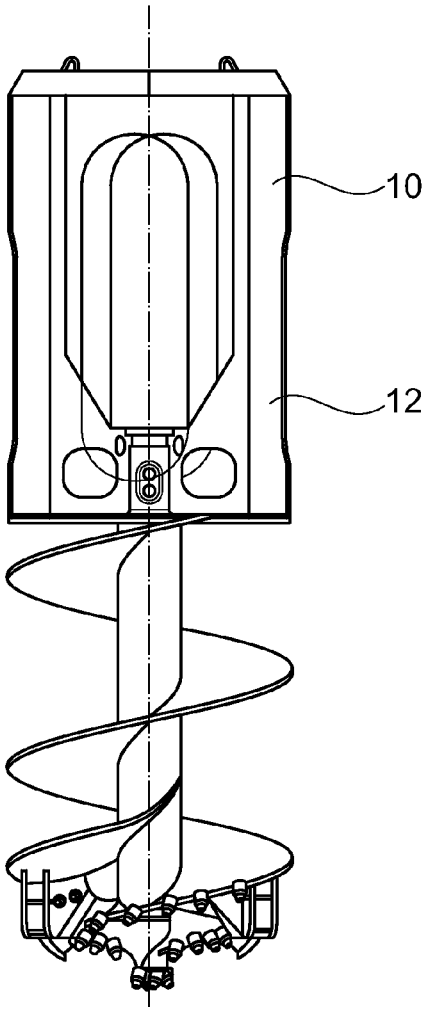
Figure 2:
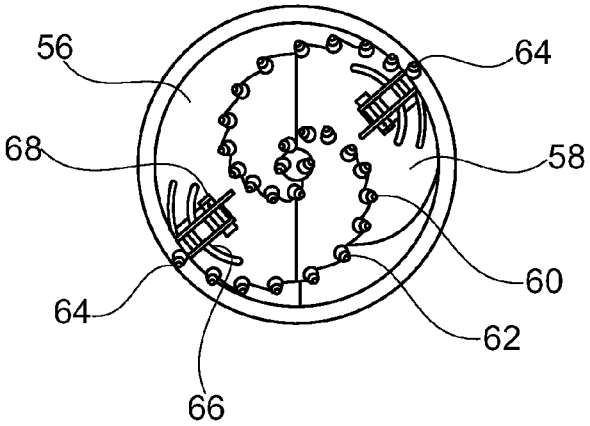
Figure 4:
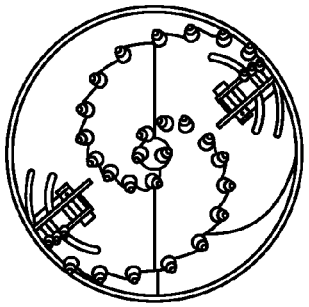
Figure 5:
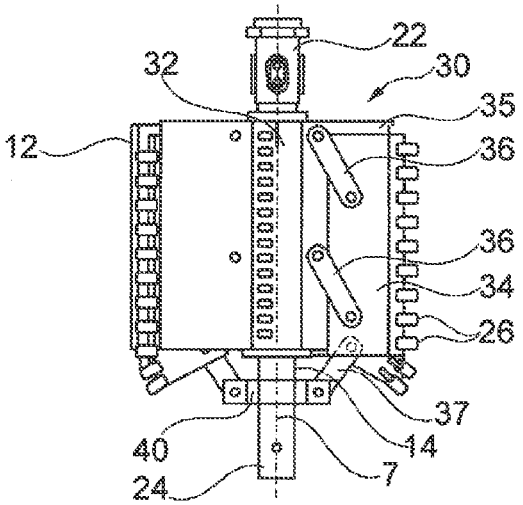
Figure 7:
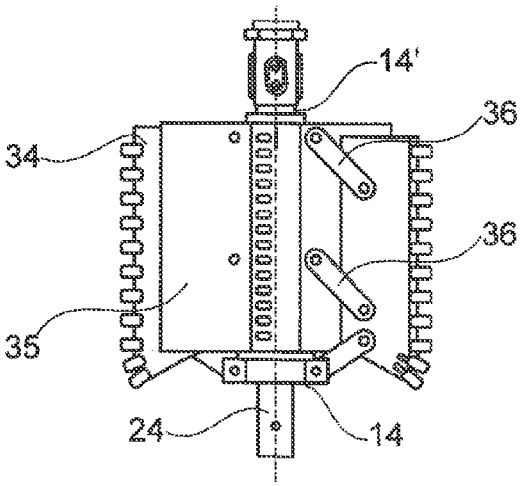
Figure 6:
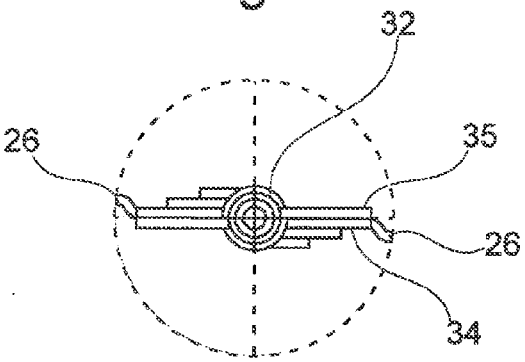
Figure 8:
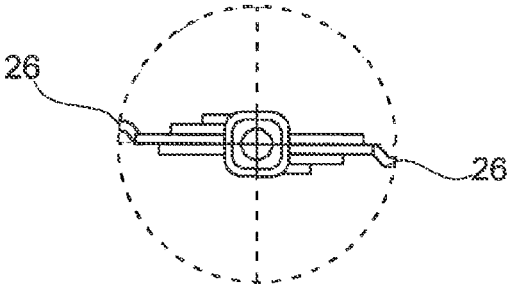
Figure 9:
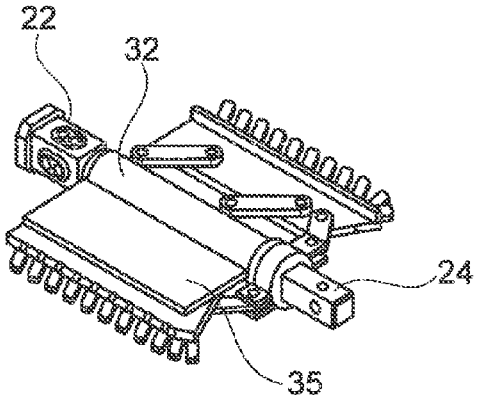
Figure 10:
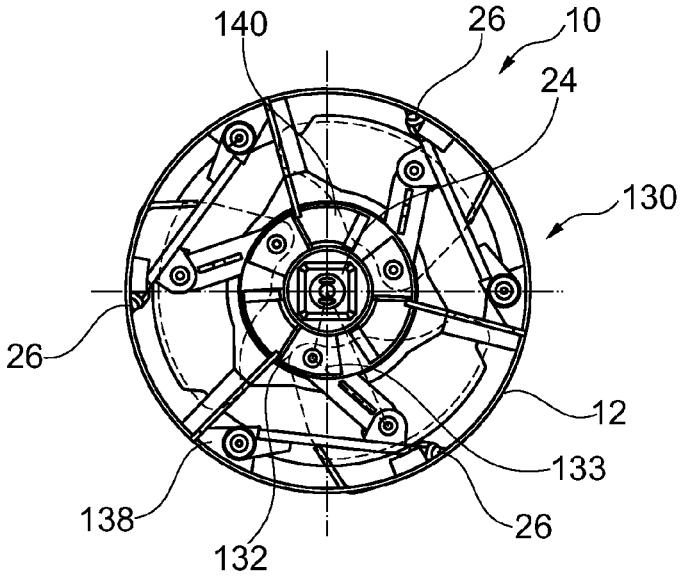
Figure 11:
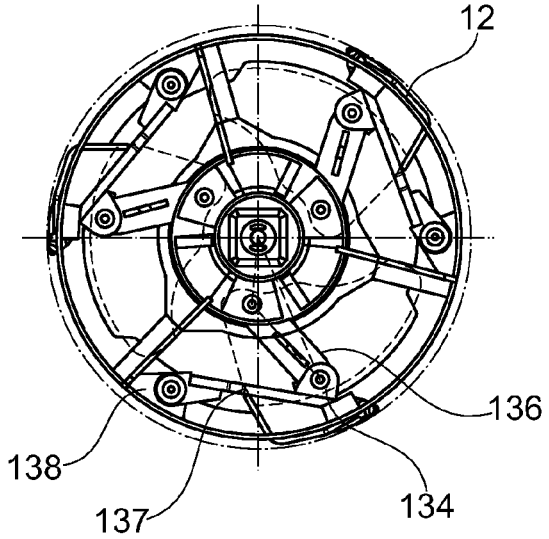
Figure 12:
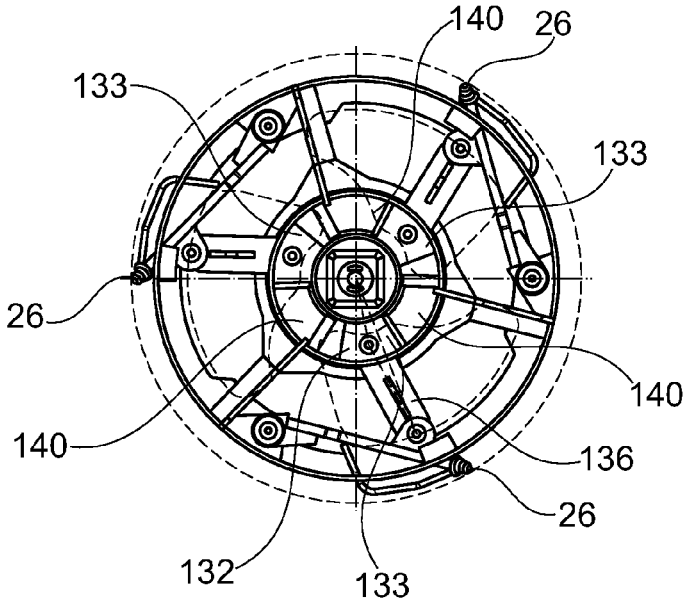
Figure 13:
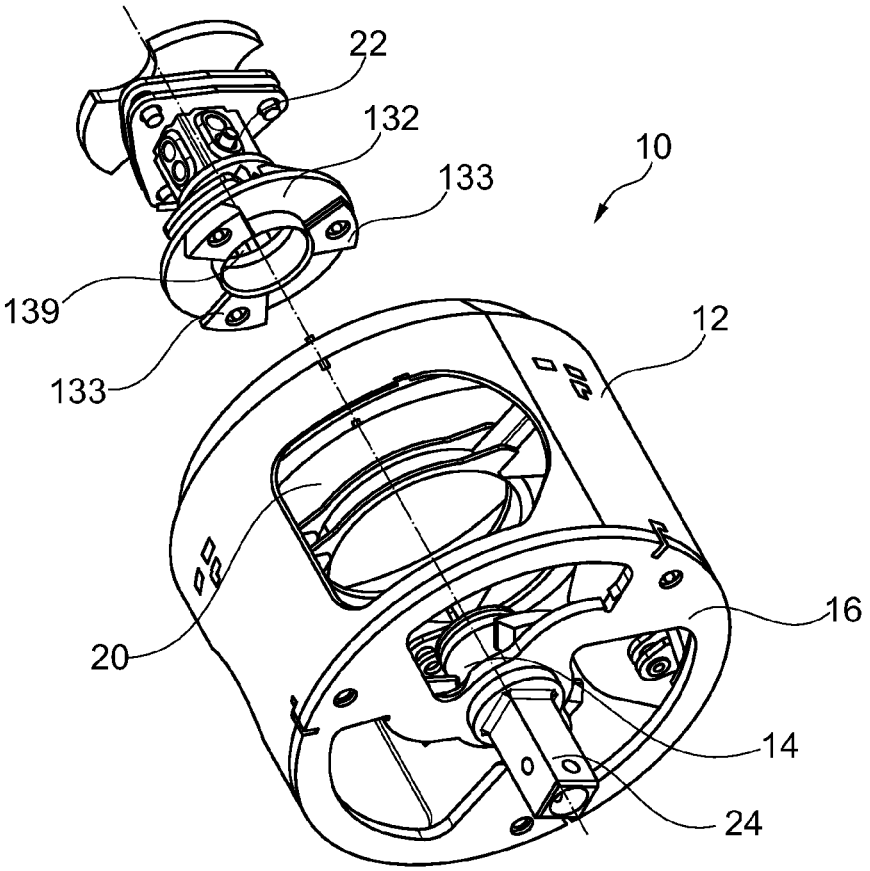
Figure 14:
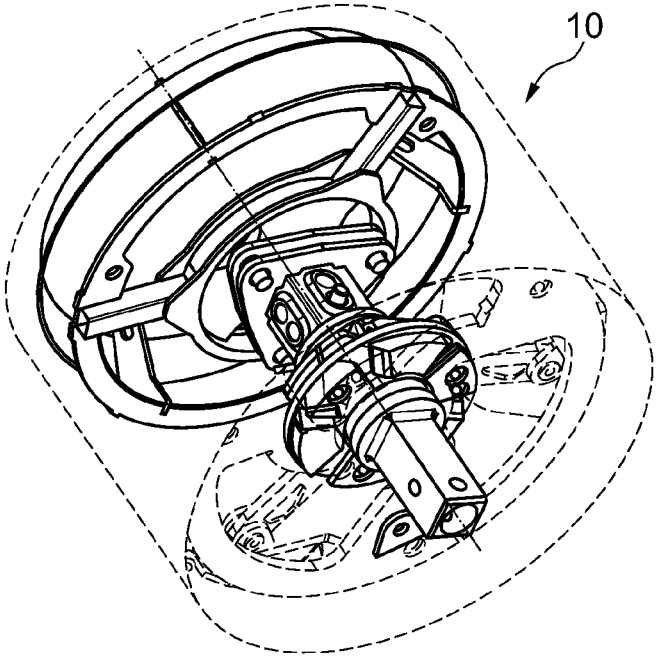

In the following the invention is described further by way of preferred embodiments shown schematically in the accompanying drawings, wherein show:

FIG. 1: a side view of a drilling tool according to the invention with extended hinged teeth;

FIG. 2: a plan view from below of the drilling tool of FIG. 1;

FIG. 3: a side view of the drilling tool of FIG. 1 with retracted hinged teeth;

FIG. 4: a plan view from below of the drilling tool of FIG. 3;

FIG. 5: a side view of a drilling tool according to the invention with sliding member in the retracted position;

FIG. 6: a plan view from below of the drilling tool of FIG. 5;

FIG. 7: a side view of the drilling tool of FIG. 5 with extended sliding member;

FIG. 8: a plan view from below of the drilling tool of FIG. 7;

FIG. 9: a perspective view of the drilling tool with sliding member;

FIGS. 10 to 12: cross-sectional views of a further drilling tool according to the invention in various radial extended positions of the removal teeth;

FIG. 13: a perspective exploded view concerning the drilling tool of FIGS. 10 to 12 but without transmission mechanism; and FIG. 14: an assembled illustration of the drilling tool of FIG. 13.

A basic construction of the drilling tool 10 according to the invention, which forms part of a drilling tool unit 5, can be gathered from FIGS. 1 to 4. The drilling tool 10 according to the invention has a frame-like, sleeve-shaped housing 12, the outer diameter of which approximately corresponds to the drilling diameter. The housing 12 has a cover element 18 at its upper side and a base element 16 at its underside. In the circumferential wall of the cylindrical housing 12 two opposite lying openings 20 for removal teeth are arranged. For the sake of clarity, the radially extensible removal teeth of the drilling tool 10 are not shown in FIGS. 1 and 3 and shall be explained below.

At the lower base element 16 of the drilling tool 10 a lower connector 24 in the form of a square Kelly connection is arranged. To form the drilling tool unit 5 a removal means 50 designed as an auger 52 is releasably mounted on the lower connector 24 on the drilling tool 10.

The auger 52 has a drill shaft 54 running coaxially to the drilling axis 7, at the lower end of which a so-called pilot bit 60 is arranged for centering. Extending along the length of the drill shaft 54 is a first drill flight 56 for conveying and receiving removed ground material. In the lower area a second drill flight 58 extends, which enables a symmetrical removal of the ground material by means of arranged cutting teeth 62. In the lower area of the first and second drill flights 56, 58 hinged teeth 64 are arranged in each case, which are arranged on a hinged tooth support 66 that is hinge-supported about a pivot bolt 68. The hinged tooth support 66 can be pivoted between a swung-in retracted position, which is illustrated in FIG. 4, and a swung-out, radially projecting removal position, which is depicted in FIG. 2.

In the unloaded state the hinged tooth support 66 pivots downwards into the retracted position according to FIG. 4. When surrounding ground material is present, the hinged tooth support 66 is pushed outwards into the position according to FIG. 2 in order to enlarge the drilling diameter with respect to the diameter of the first drill flight 56. In this manner, the hinged teeth 64 allow for an enlargement of the drilling diameter even below the drilling tool 10 according to the invention.

To form the drilling tool 10 according to the invention a removal means, illustrated and described in greater detail in conjunction with FIGS. 5 to 9, can be inserted into the housing 12 according to FIGS. 1 and 3.

A first transmission mechanism 30 has a fixing element 32 which is mounted coaxially to the drilling axis 7 on a drill rod element 14. As not shown in detail, the drill rod element 14 has a separate lower element and a second upper drill rod element 14' which is separate from the said lower element but connected thereto in a torque-proof and yet axially slidable manner. On the fixing element 32 two diametrically opposite guide plates 35 are fixed, along which a plate-shaped sliding member 34 is in each case supported in a radially movable manner. For each sliding member 34 two bearing levers 36 are arranged in each case, which are each articulated on the one hand to the fixing element 32 or rather to the guide plate 35 fixed thereon and on the other hand to the sliding member 34.

The retracted position of the sliding member 34, on the exterior of which a plurality of removal teeth 26 is releasably fixed, is shown in FIGS. 5 and 6. In the direction of the lower connector 24 a ring-shaped sliding sleeve 40 is provided, which, in being coaxial to the drilling axis 7, is supported in an axially slidable manner on the drill rod element 14. By pushing the upper connector 22 downwards in the direction of the borehole bottom the sliding sleeve 40 is pushed by the borehole bottom in the direction of the fixing element 32. On the sliding sleeve deflection levers 37 are articulated. During the downward pushing movement, the deflection levers 37 as well as the bearing levers 36 are pivoted into a flatter angular position, which is shown in FIG. 7. As a result of this pivoting movement of the deflection levers 37 the sliding member 34, which is supported in a radially slidable manner, is adjusted radially outwards along the guide plate 35. As illustrated in FIGS. 7 and 8, the removal teeth 26 are in this way adjusted from a smaller first drilling diameter, which is determined by the removal means 50, in the radial outward direction towards the outside of the housing 12 depicted schematically only in FIG. 5. The axial length of stroke of the sliding sleeve 40 is limited by the lower area of the fixing element 32.

A further embodiment of a drilling tool 10 according to the invention with a second transmission mechanism 130 is set out in the following in conjunction with FIGS. 10 to 14.

A second transmission mechanism 130 with a rotary member 132 supported in a rotatable manner about the drilling axis 7 is shown in various operating positions in FIGS. 10 to 12. On the lower connector 24 a stop means with three stops 140 is arranged, which are evenly distributed around the circumference and designed in a segmental manner. Corresponding to this an annular-disk-shaped rotary member 132 is designed which has three drive elements 133 that are also arranged by being offset to each other by 120°.

The rotary member 132 is connected in a torque-proof manner to the upper connector 22, as can be gathered from FIG. 13 in particular. All in all, this results in a drill rod element which is connected in a torque-proof manner via the upper connector 22 to the drill rod located above so that a torque transmission can take place via the drive elements 133 and the stops 140 to the drill rod element 14 which is connected in a torque-proof manner to the lower connector 24. Internally arranged spline structures 139 substantially serve for axial guidance.

To form the second transmission mechanism 130 a deflection lever 136 is in each case pivotably articulated to the three drive elements 133. The opposite free end of the deflection lever 136 is connected in an articulated manner to a pivot member 134, on which removal teeth 26 are releasably arranged. The pivot member 134 merges into a bearing lever 137 which is pivotably supported on a bearing block 138 that is fixed on the interior of the sleeve-shaped housing 12.

In FIG. 10 the drilling tool 10 according to the invention with the second transmission mechanism 130 is depicted in the retracted position, in which the removal teeth 26 are arranged inside the housing 12. In this position the drive elements 133 of the rotary member 132 rest in a clockwise direction against the segmental stops 140 that are connected in a torque-proof manner to the housing 12 and the lower connector 24.

By twisting the rotary member 132 counter-clockwise, as shown in FIG. 11, a rotational movement of the drill rod is translated by the second transmission mechanism 130 into a radial outward movement of the removal teeth 26. The twisting of the rotary member 132 causes the deflection levers 136 to be pushed into a more radial position, as illustrated in FIG. 12. As a result, the pivot member 134 with the bearing lever 137 is moved radially outwards so that the removal teeth 26 pass through an opening in the housing 12, not shown here, emerging therefrom radially outwards into an operating position shown in FIG. 12. Accordingly, through a reverse rotational movement the removal teeth 26 can be retracted again.

As can be taken from FIG. 13, in the illustrated drilling tool 10 according to the invention the cylindrical housing 12 has three openings 20 along the circumferential wall of the housing 12 for the passage of the removal teeth 26. The respective stop surfaces of the drive elements 133 of the rotary member 132 and the corresponding stop surfaces of the stops 140 can be sloped so that the rotary member 132, when being in an axially unloaded state in which the drilling tool 10 is freely suspended on a drill rod for example, slides from the axial engaging position, shown in FIG. 14, relatively upwards by a predetermined axial stroke. It is also possible to support the rotary member 132 relative to the housing 12 so that it also stays in the axial engaging position in an axially unloaded state. This allows the drilling tool 10 to be introduced through an inserted support pipe into an already existing bore with a first diameter. Once the drilling tool 10 then rests on the borehole bottom, the upper connector 22 and the lower connector 24 are moved axially towards each other, enabling the rotary member 132 with the drive elements 133 to reach the engaging position shown in FIG. 14.

By transmitting the drilling torque counterclockwise the retracted removal teeth 26 according to FIG. 10 can be rotated into the extended operating position according to FIG. 12. In this way, an enlargement of the drilling diameter can then be implemented below a support pipe in line with the outer diameter of the extended removal teeth 26.

On completion of the bore and transmission of a drilling torque in the clockwise direction, the removal teeth 26 are retracted again by the transmission mechanism 130 from the operating position according to FIG. 12 into the retracted position according to FIG. 10. When lifting the drilling tool 10, the lower connector 24, due to the weight force now applied, is removed axially from the upper connector 22 again, and in the case of sloped drive elements 133 and sloped surfaces on the stops 140 the said drive elements 133 and the sloped surfaces on the stops 140 cause the removal teeth 26 to be retracted again by the transmission mechanism 130 from the operating position according to FIG. 12 into the retracted position according to FIG. 10.

The invention claimed is:

1. A drilling tool for earth drilling comprising:

a drill rod element which can be driven in a rotating manner about a drilling axis, a frame-like housing, and at least one removal tooth which is supported in a radially adjustable manner in the housing between a retracted position in the housing and an operating position, in which the at least one removal tooth projects radially from the housing, wherein on the drill rod element in the housing a transmission mechanism is arranged, through which a stroke and/or rotational movement of the drill rod element can be translated into a radial movement for radial adjustment of the at least one removal tooth, on an underside of the housing, removal means for removing ground at a borehole bottom is connected to the housing, the removal means comprises an auger with a drill shaft and at least one drill flight, and the drill shaft is releasably mounted on the underside via a lower connector.

2. The drilling tool according to claim 1, wherein the transmission mechanism has a sliding sleeve which is supported in an axially slidable manner along the drilling axis, in that at least one sliding member is arranged which is supported in a radially adjustable manner in the housing and on which at least one removal tooth is mounted, and in that at least one deflection lever is articulated on the one hand to the sliding sleeve and on the other hand to the sliding member, wherein an axial stroke movement of the sliding sleeve can be translated by the deflection lever into a radial positioning movement of the sliding member.

3. The drilling tool according to claim 1, wherein on an upper side of the housing, an upper connector for a drill rod is provided, and on the underside of the housing, the lower connector for the removal means for removing ground at the borehole bottom is provided.

4. The drilling tool according to claim 3, wherein by way of a fixing element the upper connector is connected to the lower connector in a torque-proof manner and by being axially slidable by a predetermined length of stroke and the axial length of stroke is limited by means of the sliding sleeve.

5. The drilling tool according to claim 1, wherein the transmission mechanism has a rotary member which is supported in a twistable manner about the drilling axis, at least one pivot member is arranged which is supported in a radially pivotable manner on the housing and on which at least one removal tooth is mounted, and at least one pivot lever is articulated on the one hand to the rotary member and on the other hand to the pivot member, wherein a twisting movement of the rotary member can be translated by the pivot lever into a radial positioning movement of the pivot member.

6. The drilling tool according to claim 5, wherein the rotary member can be twisted between a first rotational position, in which the at least one removal tooth is located in the retracted position in the housing, and a second rotational position, in which the removal tooth is located radially outside the housing in the operating position, and the rotary member can be locked in the first rotational position and/or the second rotational position.

7. The drilling tool according to claim 1, wherein on the auger in a lower area at least one hinged tooth is arranged which, when surrounding ground is present, can be swung out from a swung-in retracted position into a radially projecting removal position.

8. A method for producing a bore in the ground, wherein the ground is removed with a drilling tool according to claim 1.

9. The method according to claim 8, wherein initially a cased bore is produced with a support pipe having an inner diameter and an outer diameter up to a first drilling depth, a subsequent bore is continued below the support pipe up to a second drilling depth, wherein the subsequent bore has a drilling diameter corresponding to the inner diameter of the support pipe, and at least in a partial area the drilling diameter of the subsequent bore is enlarged with the drilling tool according to claim 1 up to a drilling diameter which is equal to or larger than the outer diameter of the support pipe.

* * * * *